US005395104A

United States Patent [19]

Harada et al.

[11] Patent Number: 5,395,104

[45] Date of Patent: Mar. 7, 1995

[54] PAPER CONVEYING DEVICE

[75] Inventors: Hiroyuki Harada; Yasuhiko Kida, both of Osaka, Japan

[73] Assignee: Mita Industrial Co., Ltd., Osaka, Japan

[21] Appl. No.: 186,761

[22] Filed: Jan. 25, 1994

[30] Foreign Application Priority Data

Jan. 27, 1993 [JP] Japan ..... 5-011331

[51] Int. Cl.[6] ..... B65H 9/00

[52] U.S. Cl. ..... 271/256; 271/225; 271/902

[58] Field of Search ..... 271/227, 258, 259, 902, 271/256

[56] References Cited

U.S. PATENT DOCUMENTS 5,197,723 3/1993 Yamada ..... 271/902 X 5,229,816 7/1993 Fujimoto ..... 271/902 X

*Primary Examiner*—Richard A. Schacher

*Attorney, Agent, or Firm*—R. Lawrence Sahr

[57] ABSTRACT

A paper conveying device overruns a document from a stop position and then, switches the document back so that the end of the document collies with a document abutting member provided in the stop position. At this time, the amount of overrun and the amount of switchback of the document are respectively set to the minimum ones required, to reduce the stress applied to the document, and the most suitable control is carried out even in a special mode (SDF mode) in which the document conveying speed is low. More specifically, at the time of the SDF mode, even if a stop instruction is given at timing T2, timing at which a conveying motor is turned off is delayed by a short time ΔT. A distance A′ from the timing T2 to the time when the conveying motor is completely stopped is detected, and the conveying motor is rotated in the reverse direction by a distance B′ equal to the distance A′. The conveying motor is rotated in the reverse direction by position control. Consequently, in not only an ADF mode in which the document is conveyed at the standard speed but also the SDF mode in which the conveying speed is low, running distance data required for switchback control is obtained, thereby to make it possible to carry out the most suitable position control.

8 Claims, 9 Drawing Sheets

<IN THE ADF MODE>

<IN THE SDF MODE>

PAPER CONVEYING DEVICE

BACKGROUND OF THE INVENTION

1. Field of the Invention

The present invention relates to a paper conveying device for conveying paper such as a document, and more particularly, to an automatic paper conveying device mounted on a copying machine or the like for automatically setting paper such as a document in a predetermined position.

2. Description of the Related Art

An automatic document conveying device mounted on a copying machine, a facsimile or the like for conveying a document which is one type of paper so as to automatically set the document in a predetermined position has been known.

Many of conventional automatic document conveying devices include a mechanism for conveying a document by a conveying belt. In this type of automatic document conveying device, control is so carried out that when the document is set, the front end or the rear end of the document is stopped along a predetermined reference line.

One of methods of control conventionally carried out so as to exactly stop the end of a document along a reference line is a method of overrunning once the end of a document by a predetermined amount from the position where the document is set and then, driving a conveying belt in the reverse direction to switch the document back so that the end of the document collides with a projection provided in the position of the reference line. In such a method of switching the document back, control for overrunning the document and switching the document back has been conventionally managed by time.

The method of switching the document back so that the end of the document collides with the projection provided in the position of the reference line has the advantage that the document can be exactly stopped in the position of the reference line, while having the disadvantage in that the stress is applied to the document at the time of the collision and consequently the document is liable to be, for example, wrinkled or folded. Particularly in the method of managing the amount of overrun and the amount of switchback of the document by time in the prior art, sufficient time for management must be set and a sufficient amount for switchback is set. Accordingly, a force is exerted on the document after the end of the document collides with the projection, to increase the stress applied to the document.

Since sufficient time for management is set, the document is overrun and switched back by a distance greater than necessary in many cases. Therefore, the system also has the disadvantages in that it takes long to set the document and it also takes long to replace the document with another document.

In order to eliminate the disadvantages in the prior art, the applicant of the present application has previously proposed an improved paper conveying device (see U.S. patent application Ser. No. 08/077,010).

The paper conveying device previously proposed is so constructed that control of a motor for driving a conveying mechanism is improved to overrun paper by the minimum distance required and switch the paper back exactly by the amount of overrun. Therefore, the paper conveying device is superior in that the stress applied to the paper can be reduced and consequently the paper is hardly damaged, and time required until the paper is stopped in a predetermined position may be short.

In putting the above described paper conveying device in the prior application to practical use, however, the following becomes clear. Specifically, if the paper conveying speed is lower than the standard speed in a case where the paper is overrun by coasting, the coasting distance of the paper does not reach a distance required for control. Specifically, some problems are found out. For example, if the conveying speed is low, the coasting distance becomes short, so that a part of the end of the paper may not, in some cases, overrun the position of a reference line.

SUMMARY OF THE INVENTION

An object of the present invention is to provide a paper conveying device, which is a further improvement over the paper conveying device previously proposed, capable of reducing the stress applied to paper and capable of feeding the paper to a predetermined position accurately in a short time.

According to the present invention, when mode determining means does not determine that the operation mode is a predetermined mode, the application of a driving signal to paper conveying means is stopped immediately after a stop signal is outputted. Consequently, the paper conveying means is decelerated to be stopped immediately after the stop signal is outputted.

On the other hand, when the mode determining means determines that the operation mode is the predetermined mode, the application of the driving signal to the paper conveying means is not stopped immediately after the stop signal is outputted. Alternatively, the driving signal is applied only for a predetermined short time continuously after the stop signal is outputted.

Furthermore, when the mode determining means determines that the operation mode is the predetermined mode, counting means starts to count pulses at the time point where the stop signal is outputted. Accordingly, the number of pulses becomes the number of pulses at the time of movement of the paper conveying means in a time period during which an additional driving signal is outputted and at the time of later coasting by the inertia. Consequently, if the predetermined mode is a mode in which the moving speed of the paper conveying means is low, the number of pulses counted by the counting means becomes large, to obtain the number of pulses necessary and sufficient at the time of later position control for switching the paper back.

According to the present invention, therefore, in the device for conveying paper such as a document, the paper can be exactly stopped in a predetermined position in conveying the paper to a predetermined position.

Particularly when the paper conveying speed is switched to a conveying speed lower than the standard speed depending on, for example, the thickness of the paper, the coasting distance of the paper caused by the fact that the paper conveying speed becomes low is corrected most suitably. Accordingly, the paper is subjected to necessary and sufficient switchback control, thereby to make it possible to reduce the stress applied to the paper at the time of switchback. As a result, there is provided a good paper conveying device which hardly damages the paper.

According to a preferred aspect of the present invention, additional driving signal outputting means outputs an additional driving signal until a predetermined number of pulses are outputted from pulse outputting means. Therefore, a time period during which the additional driving signal is outputted is controlled by not time but the number of pulses, that is, the distance, thereby to make it possible to carry out output control of the additional driving signal more accurately.

In accordance with another preferred aspect of the present invention, the amount of movement of the paper conveying means can be detected as the amount of rotation of the conveying motor, thereby to make it possible to set the paper conveyed by the paper conveying means in a predetermined position by position control of the conveying motor.

In accordance with still another preferred aspect of the present invention, the amount of movement of the paper can be detected by movement of a paper conveying belt provided in the paper conveying means, thereby to make it possible to carry out position control of the paper more accurately.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Description is made of control of a document conveying motor in an automatic document conveying device mounted on an electrophotographic copying machine or the like by way of example as one embodiment of the present invention.

Figure 1:
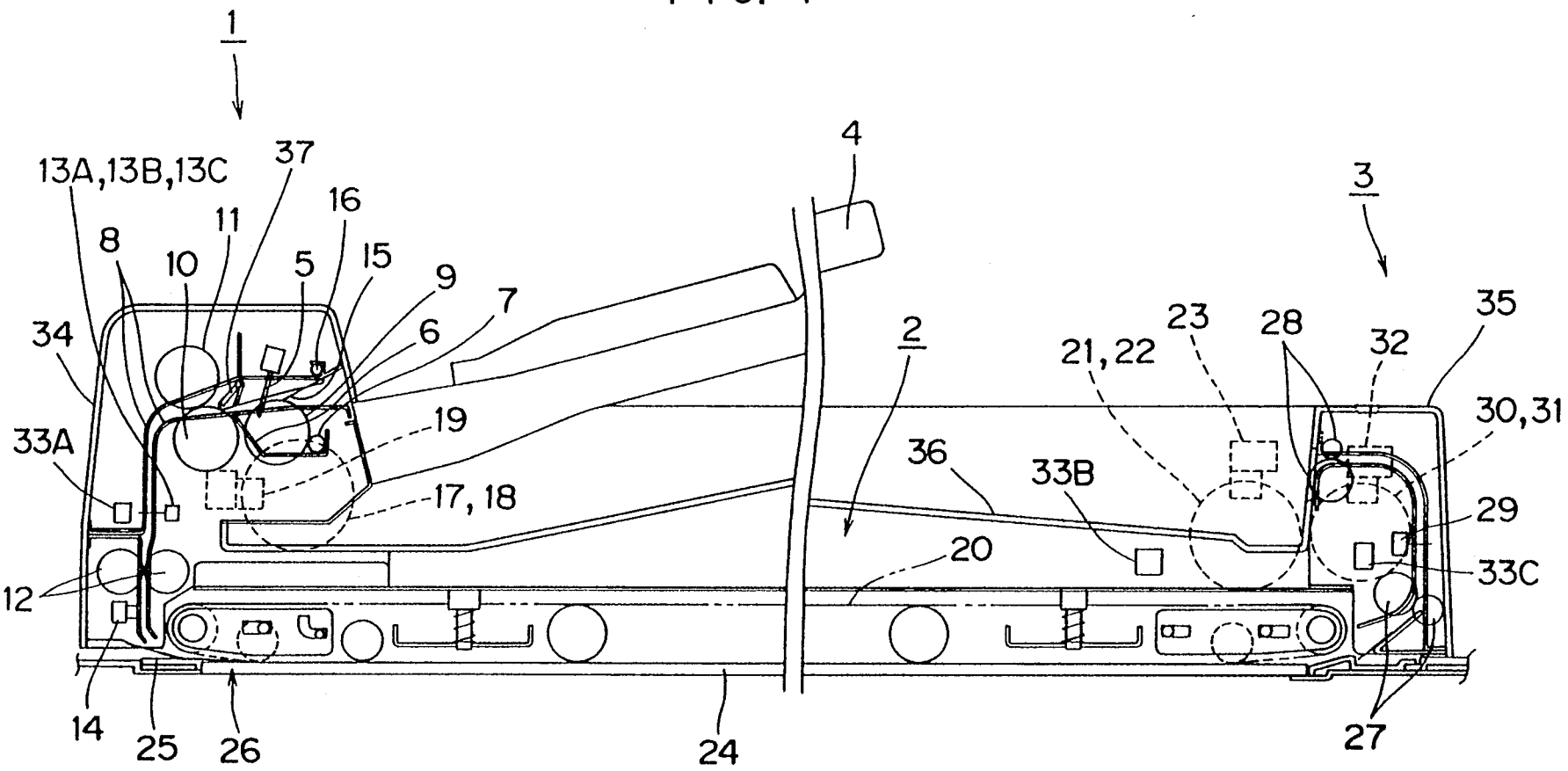
FIG. 1 is a sectional side elevation illustrating an automatic document conveying device to which one embodiment of the present embodiment is applied.

FIG. 1 is a sectional side elevation showing an automatic document conveying device to which one embodiment of the present invention is applied, in which the intermediate portion is not shown. This automatic document conveying device comprises a paper feeding section 1, a belt conveying section 2, and a paper discharging section 3.

The paper feeding section 1 comprises a document setting stand 4, a document setting switch 5 for detecting, when a document is properly set on the document setting stand 4, the setting of the document, a stopper member 6, and a document pressing member 15.

The stopper member 6 is provided so as to be rotatable around a supporting point 7 and abuts against the front end of the document in a position as shown in the figure when the document is not fed, to prevent the document from being fed. On the other hand, the stopper member 6 is rotated in the counterclockwise direction around the supporting point 7 when the document is fed, to allow the document to be fed.

The document pressing member 15 is provided so as to be shakable around a supporting point 16 and can be switched by a solenoid (not shown) between a state where the forward end thereof is pushed downward and a state where the forward end thereof is not pushed down. This document pressing member 15 is for exerting a force not less than its own weight to the document at the time of paper feeding to press the document against a forward roller 9 as described below.

The paper feeding section 1 further comprises a conveying guide 8 for guiding the document fed, the forward roller 9 for forwarding the document, a pair of a paper feeding roller 10 and a reverse roller 11 for preventing documents from being fed with they being overlapped with each other to feed the documents one at a time, a separation plate 37 provided just ahead of the paper feeding roller 10 for separating the documents fed to the paper feeding roller 10 from each other, a pair of registration rollers 12 for feeding the document by secondary paper feeding to the belt conveying section 2 at predetermined timing, and a registration switch 13A and size switches 13B and 13C provided on the upstream side of the registration roller 12 for detecting, when the document is fed to the registration roller 12, the feeding of the document. The registration switch 13A and the size switches 13B and 13C are disposed in the direction orthogonal to the surface of the figure. In addition, a feed switch 14 for detecting the document fed by secondary paper feeding to the belt conveying section 2 is included on the downstream side of the registration roller 12.

The paper feeding section 1 further comprises a paper feeding motor 17 serving as a driving source. The torque produced by the paper feeding motor 17 is transmitted to the forward roller 9 and the paper feeding roller 10 through a paper feeding clutch (not shown), and is further transmitted to the registration roller 12 through a registration clutch (not shown). The paper feeding motor 17 is provided with a rotating disc 18 mounted on its axis of rotation and having a lot of slits, for example, in a radial manner and a photointerrupter for a paper feeding motor 19 optically coupled to the rotating disc 18. Accordingly, it is possible to detect the rotating state of the paper feeding motor 17 by an output pulse of the photointerrupter for a paper feeding motor 19.

The belt conveying section 2 comprises a conveying belt 20 for conveying the document and a conveying motor 21 for driving the conveying belt 20. The conveying motor 21 is also provided with a rotating disc 22 mounted on its axis of rotation and having a lot of slits, for example, in a radial manner and a photointerrupter for a conveying motor 23 optically coupled to the rotating disc 22. Accordingly, it is possible to detect the rotating state of the conveying motor 21 by an output pulse of the photointerrupter for a conveying motor 23.

The lower surface of the conveying belt 20 is brought into contact with a transparent platen 24 mounted on the electrophotographic copying machine. A document abutting member 25 is mounted on the side of the forward end (on the left side in the figure) of the transparent platen 24. The document abutting member 25 has a projected end side having a difference in level from the surface of the transparent platen 24, and this end side constitutes a reference line 26 in a case where the document is set on the transparent platen 24.

The paper discharging section 3 comprises a pair of document feeding rollers 27, a pair of discharge rollers 28, a discharge switch for detecting the document discharged, and a discharged paper receiving section 36. In addition, there is provided a discharge motor 30 serving as a driving source of the paper discharging section 3. This discharge motor 30 is also provided with a rotating disc 31 mounted on its axis of rotation and having a lot of slits, for example, in a radial manner and a photointerrupter for a discharge motor 32 optically coupled to the rotating disc 31. Accordingly, it is possible to detect the rotating state of the discharge motor 30 by an output pulse of the photointerrupter for a discharge motor 32.

This automatic document conveying device further comprises three safety switches 33A, 33B and 33C (generally called "safety switches 33"). The safety switch 33A is a switch which is turned off when a cover 34 of the paper feeding section 1 is opened, the safety switch 33B is a switch which is turned off when the belt conveying section 2 is lifted from the transparent platen 24, and the safety switch 33C is a switch which is turned off when a cover 35 of the paper discharging section 3 is opened. This automatic document conveying device can be operated when all the safety switches 33 are turned on.

Figure 2:
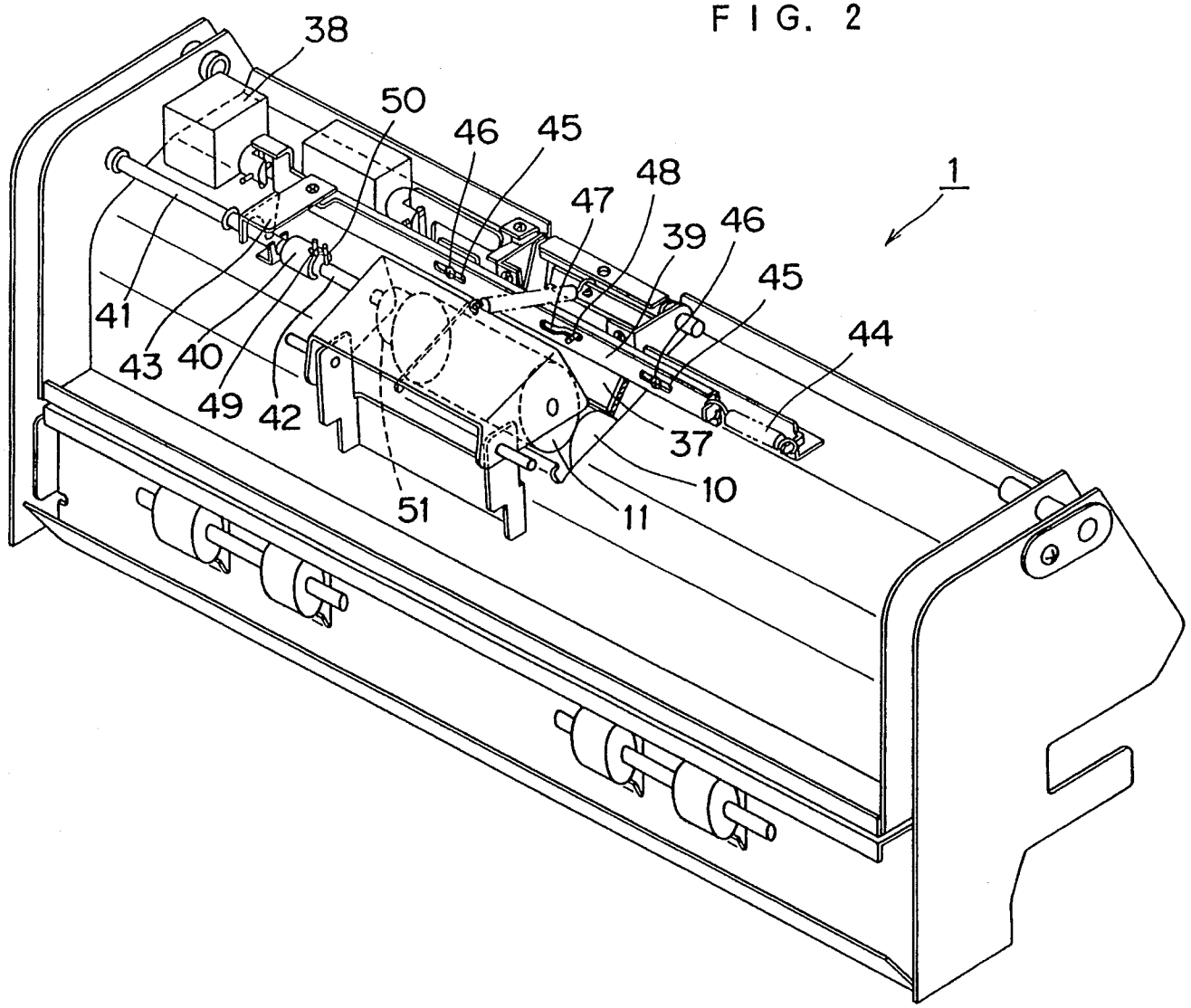
FIG. 2 is a perspective view showing the construction of a paper feeding section in the automatic document conveying device.

FIG. 2 is a perspective view showing the construction of the paper feeding section 1 in the automatic document conveying device. Referring to FIG. 2, the construction of the paper feeding section 1 will be additionally described.

The paper feeding section 1 can be switched between an ADF mode in which documents are so separated from each other as to be fed one at a time by a separation plate 37 and a reverse roller 11 and an SDF mode in which documents are not separated from each other in such a manner that the separation plate 37 and the reverse roller 11 do not function. Therefore, the paper feeding section 1 comprises an SDF solenoid for mode switching 38, a sliding plate 39 which has its one end connected to the SDF solenoid 38 and is slid in the lateral direction by switching the on and off states of the SDF solenoid 38, and a point mechanism 40.

The sliding plate 39 is a longitudinal plate-shaped member as shown in the figure. A return spring 44 is connected to an end opposite to the end to which the SDF solenoid 38 is connected. When the SDF solenoid 38 is turned off, the sliding plate 39 is pulled rightward in the figure by the return spring 44. Two long holes 45 extending in the direction of sliding are formed in the sliding plate 39, and the long holes 45 are respectively fitted in supporting pins 46. Consequently, the sliding plate 39 is slidable in the lateral direction within the range of the length of the long hole 45.

A stepped hole 47 is also formed in the sliding plate 39, and an engaging pin 48 projected from the separation plate 37 engages with the stepped hole 47. When the sliding plate 39 is slid leftward as shown in the figure, the engaging pin 48 engages with the upper step of the stepped hole 47. Accordingly, the engaging pin 48 is displaced upward, resulting in a state where the separation plate 37 is not brought into contact with the peripheral surface of the paper feeding roller 10. On the other hand, in a case where the SDF solenoid 38 is turned off, the sliding plate 39 is slid rightward, the engaging pin 48 engages with the lower step of the stepped hole 47. Accordingly, the engaging pin 48 is displaced downward, resulting in a state where the separation plate 37 is moved downward to be brought into contact with the peripheral surface of the paper feeding roller 10, to separate the documents from each other.

The joint mechanism 40 is a mechanism which can be switched between a state where the torque produced by a driving shaft 41 is transmitted to a roller shaft 42 to which the reverse roller 11 is attached and a state where it is not transmitted thereto. The sliding plate 39 and the joint mechanism 40 are connected to each other by an adjusting plate 43 so that the above described switching of the joint mechanism 40 is allowed in synchronism with the sliding of the sliding plate 39.

More specifically, when the sliding plate 39 is slid leftward, the joint mechanism 40 is moved leftward in synchronism with the sliding of the sliding plate 39, resulting in a state where the joint mechanism 40 is disconnected from the roller shaft 42, as shown in FIG. 2. In this state, the torque produced by the driving shaft 41 is not transmitted to the roller shaft 42. On the other hand, when the sliding plate 39 is slid rightward, the point mechanism 40 is moved rightward in synchronism with the sliding of the sliding plate 39, resulting in a state where an engaging recession 49 formed in the point mechanism 40 and an engaging pin 50 formed in the roller shaft 42 are fitted to each other, so that the joint mechanism 40 and the roller shaft 42 are connected to each other. In this state, the torque produced by the driving shaft 41 is transmitted to the roller shaft 42, so that the reverse roller 11 can be rotated in the reverse direction through a limiter 51.

Since the paper feeding section 1 is thus constructed, the sliding plate 39 and the joint mechanism 40 can be slid leftward by turning the SDF solenoid 38 on, while the sliding plate 39 and the joint mechanism 40 can be slid rightward by turning the SDF solenoid 38 off. The on and off states of the SDF solenoid 38 can be switched depending on whether or not the SDF mode is selected, as described later.

Figure 3:
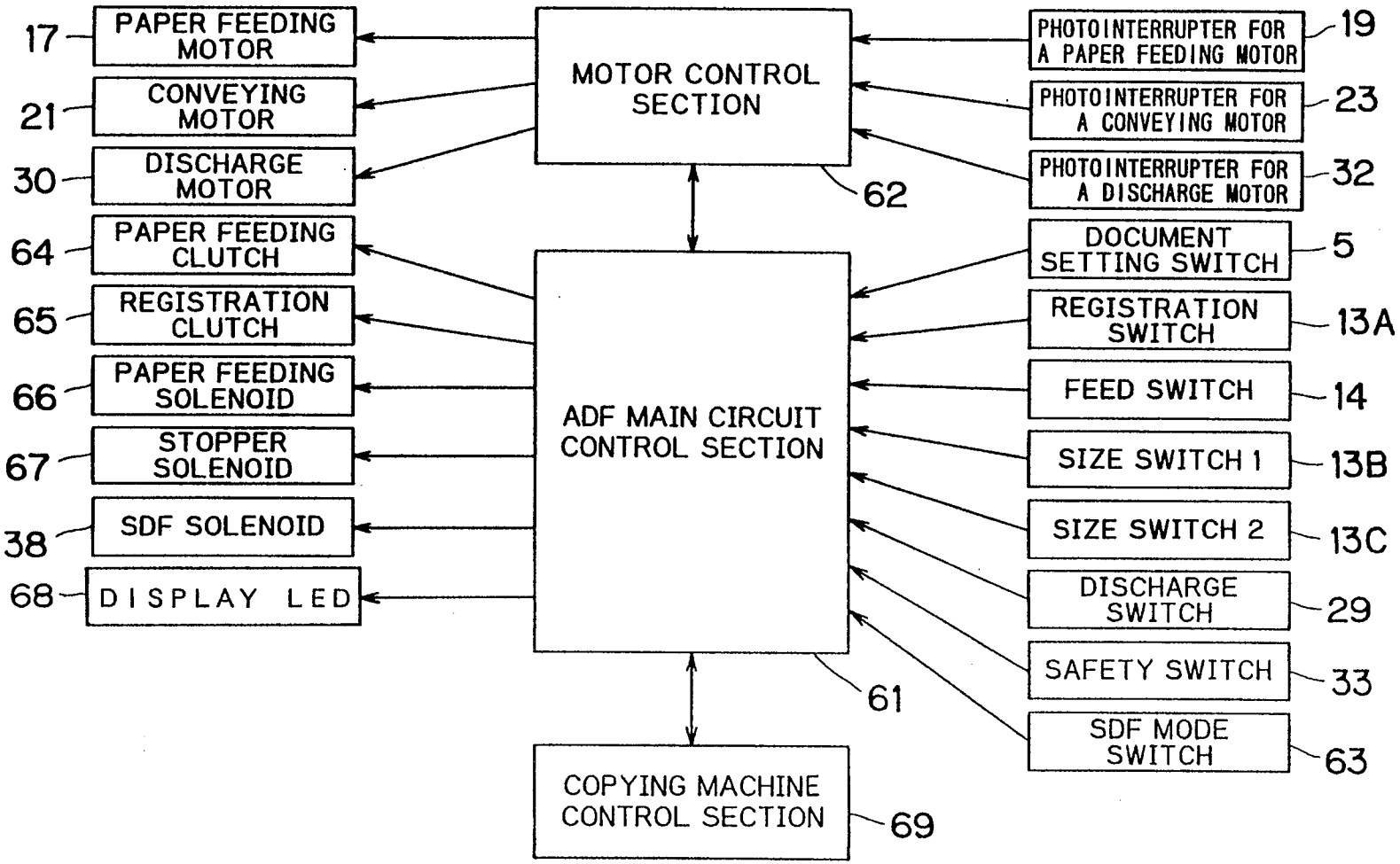
FIG. 3 is a block diagram showing the electrical construction of the automatic document conveying device.

FIG. 3 is a block diagram showing the electrical construction of this automatic document conveying device. The automatic document conveying device comprises an ADF main circuit control section 61 provided with a microcomputer and the like and a motor control section 62 similarly provided with a microcomputer and the like. Both the control sections 61 and 62 are electrically connected to each other.

Meanwhile, both of control sections 61 and 62 may be formed on single control plate and in such a case, the ADF main circuit control section 61 and the motor control section 62 are constructed by a single-chip microcomputer.

Signals of the document setting switch 5, the registration switch 13A, the size switch 13B, the size switch 13C, the feed switch 14, the discharge switch 29, and three safety switches 33 are applied to the ADF main circuit control section 61. In addition, a signal of an SDF mode switch 63 provided in an operation panel (not shown) or the like for setting an SDF mode is also applied thereto.

The ADF main circuit control section 61 applies a control signal to the motor control section 62 on the basis of the signals from the respective switches. In addition, the control signal outputted from the ADF main circuit control section 61 is applied to a paper feeding clutch 64 for transmitting or disconnecting the torque produced by a paper feeding motor 17 described in FIG. 1 to and from a forward roller 9 and a paper feeding roller 10, a registration clutch 65 for transmitting or disconnecting the torque produced by the paper feeding motor 17 to and from a registration roller 12, a paper feeding solenoid 66 for switching the state of a document pressing member 15, a stopper solenoid 67 for switching the state of a stopper member 6, an SDF solenoid 38 described in FIG. 2, and a display LED 68 for displaying whether the apparatus is in an ADF mode or an SDF mode and various informations required.

On the other hand, output pulses of a photointerrupter for a paper feeding motor 19, a photointerrupter for a conveying motor 23, and a photointerrupter for a discharge motor 32 are applied to the motor control section 62. The motor control section 62 controls the paper feeding motor 17, a conveying motor 21, and a discharge motor 30 on the basis of the pulses from the respective photointerrupters 19, 23 and 32 and the control signal from the ADF main circuit control section 61.

Furthermore, a copying machine control section 69 and the ADF main circuit control section 61 are electrically connected to each other so that this automatic document conveying device mounted on a copying machine is under the control of the copying machine control section 69 of the copying machine.

Figure 4:
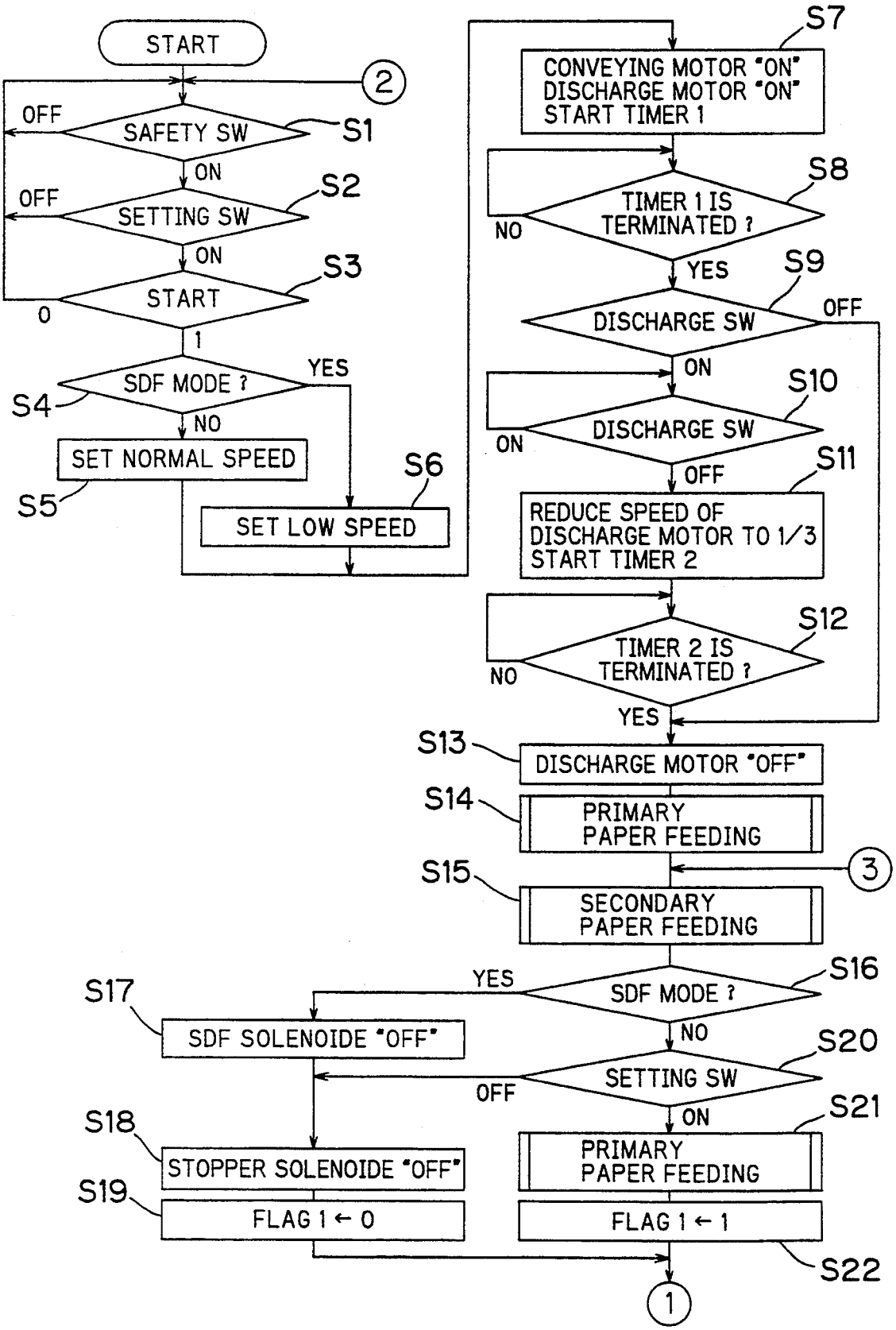
FIG. 4 is a flow chart showing the procedure for control carried out by an ADF main circuit control section 61 and a motor control section 62.
Figure 5:
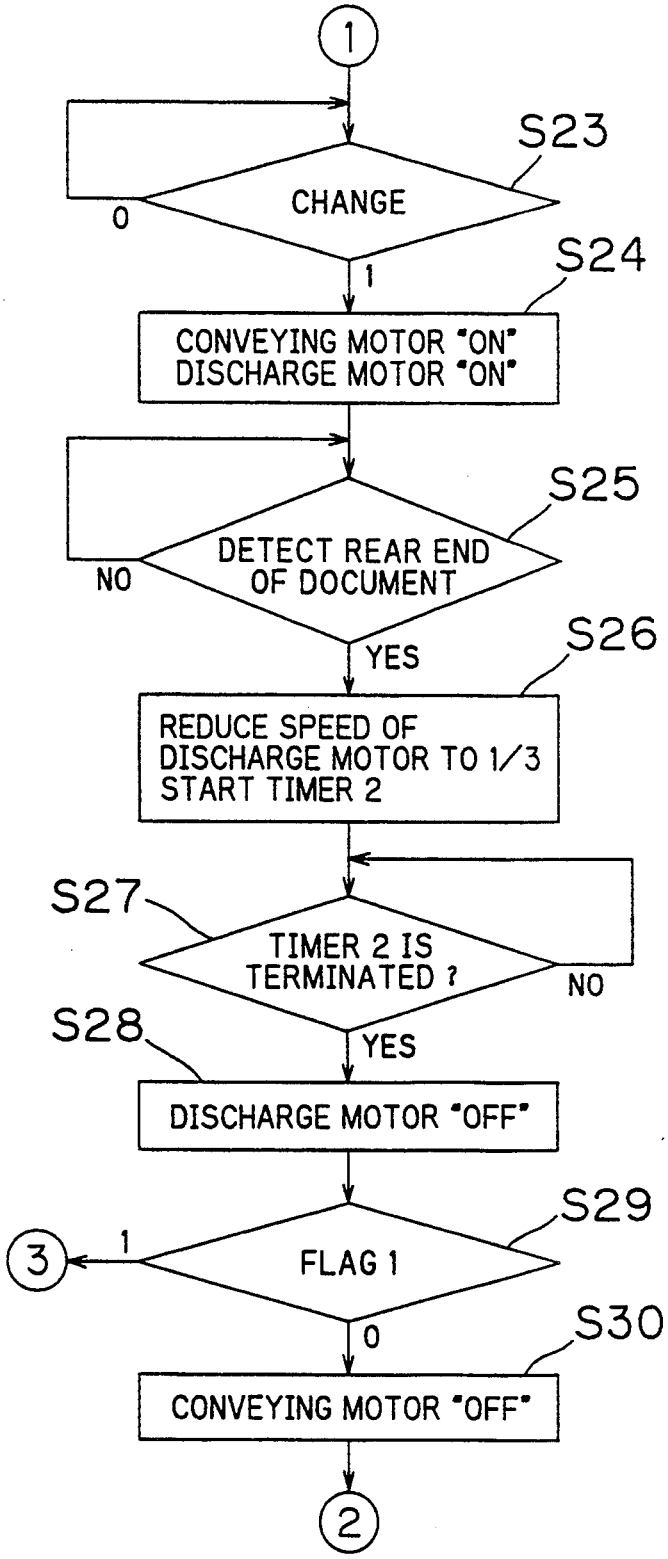
FIG. 5 is a flow chart showing the procedure for control carried out by an ADF main circuit control section 61 and a motor control section 62.

FIGS. 4 and 5 are flow charts showing the procedure for control of the entire operation of the automatic document conveying device which is carried out by the ADF main circuit control section 61 and the motor control section 62 shown in FIG. 3.

Description is now made in accordance with the flow of FIGS. 4 and 5 while referring to FIGS. 1 and 3.

When control is started, it is judged whether or not the safety switches 33 are turned on (Step S1). When any one of the safety switches 33 is turned off, a control operation is not performed because the covers 34 and 35 are opened.

If it is confirmed that all the safety switches 33 are turned on, it is then judged whether or not the document setting switch 5 is turned on (step S2). If a document is set on the document setting stand 4, the document setting switch 5 is turned on. At this time, it is further judged whether or not a "START" signal indicating the start of control is applied from the copying machine control section 69 (step S3).

If all the conditions in the steps S1 to S3 are established, it is then judged whether or not the SDF mode is selected (step S4). When the SDF mode switch 63 is turned on, it is judged that the SDF mode is selected. The SDF mode is a mode for feeding documents one at a time, in which the documents are not separated from each other at the time of primary paper feeding. This mode is a mode so contrived that when soft documents and thin documents are fed, the documents are not, for example, jammed by the separation of the documents. In the SDF mode, the documents are conveyed more slowly, as compared with the ADF mode which is a normal mode.

If it is judged in the step S4 that the SDF mode is selected, therefore, a low conveying speed is set (step S6). On the other hand, it is judged in the step S4 that the SDF mode is not selected, a normal conveying speed is set because the ADF mode which is a normal mode is selected (step S5).

In order to convey the documents at the conveying speed set in the step S5 or S6, the conveying motor 21 and the discharge motor 30 are turned on, and a timer t1 is started (step S7). The control in the steps S7 to S13 is control for recovering left documents. Therefore, the timer 1 is so set as to measure very short first predetermined time required until left documents on, for example, the transparent platen 24 are fed to the paper discharging section 3 by the conveying belt 20. If the measurement of time made by the timer 1 is terminated (step S8), the state of the discharge switch 29 is judged (step S9). If the discharge switch 29 is turned off immediately after the measurement of time made by the timer 1 is terminated, there are no left documents, so that the discharge motor 30 is turned off (step S13).

On the other hand, if the discharge switch 29 is turned on immediately after the measurement of time made by the timer 1 is terminated, there are left documents, so that the program waits until the discharge switch 29 is turned off (step S10).

If the discharge switch 29 is changed from an on state to an off state, it is considered that the rear end of the document discharged passes through the discharge switch 29. At this time point, therefore, the speed of the discharge motor 30 is reduced to, for example, one third, and a timer 2 is started (step S11). The discharge motor 30 is decelerated so as to prevent the document discharged to the discharged paper receiving section 36 from being jumped out too vigorously to be disarranged. The timer 2 measures second predetermined time required until the rear end of the document detected by the discharge switch 29 is discharged from the discharge roller 28.

When the measurement of time made by the timer 2 is terminated (step S12), the discharge motor 30 is turned off (step S13).

The left documents are removed in the foregoing manner, followed by primary paper feeding (step S14). The primary paper feeding is to feed the document on the document setting stand 4 to the registration roller 12. The primary paper feeding is followed by secondary paper feeding (step S15). The secondary paper feeding is to feed the document by the registration roller 12 and properly set the document in a predetermined position by the conveying belt 20.

The detailed control concerning the primary paper feeding and the secondary paper feeding will be described in detail after describing the whole processing.

It is then judged in the step S16 whether or not the SDF mode is selected. When the SDF mode switch 63 is turned on, it is judged that the SDF mode is selected. The SDF mode is a mode for feeding documents one at a time as described above, in which the documents are not separated from each other at the time of the primary paper feeding.

If it is judged that the SDF mode is selected, the SDF solenoid 38 described in FIG. 2 is turned off (step S17), the stopper solenoid 67 is turned off (step S18), and a flag 1 is reset (step S19).

If the stopper solenoid 67 is turned off, the stopper member 6 enters a state where it prevents the document from being fed as shown in FIG. 1. Accordingly, the subsequent document is inhibited from being fed. In addition, the flag 1 is a flag for indicating whether or not the document is fed by the primary paper feeding. For example, the flag 1 indicates that the document is not fed by the primary paper feeding if it is reset.

When in the step S16, the SDF mode is not selected, that is, the ADF mode which is a normal mode is selected, it is judged whether or not the document setting switch 5 is turned on (step S20). When there is a document on the document setting stand 4, the document setting switch 5 is turned on, so that the subsequent document is fed by the primary paper feeding (step S21). In order to indicate that the document is fed by the primary paper feeding, the flag 1 is set (step S22).

When it is judged in the step S20 that the document setting switch 5 is turned off because there is no subsequent document, the stopper solenoid 67 is turned off. Consequently, a passage is closed by the stopper member 6 (step S18), and the flag 1 is reset (step S19).

It is then judged whether or not processing on the side of the copying machine based on the document fed by the secondary paper feeding, that is, copying processing is terminated, and a "CHANGE" signal is inputted from the copying machine control section 69 (step S23). If it is judged that this signal is inputted, the conveying motor 21 and the discharge motor 30 are turned on (step S24), so that the discharge of the document is started. If the rear end of the document discharged is detected by the discharge switch 29 (YES in the step S25), the rotation speed of the discharge motor 30 is reduced to one third, and the timer 2 is started (step 26). When the measurement of time made by the timer 2 is terminated (YES in the step S27), the discharge motor 30 is turned off (step S28). Consequently, the documents discharged into the discharged paper receiving section 36 are exactly lined up. In addition, the discharge motor 30 is not rotated any more than necessary.

The state of the flag 1 is then Judged (step S29). The flag 1 indicates whether or not the document is fed by the primary paper feeding, as described above. If the document is fed by the primary paper feeding because the flag 1 is set, therefore, the program proceeds to the secondary paper feeding in the step S15 again.

On the other hand, if the flag 1 is reset, the document is not fed by the primary paper feeding. Therefore, there is no document to be subsequently conveyed. Accordingly, the conveying motor 21 is turned off (step 30). The program is returned to the step S1.

Figure 6:
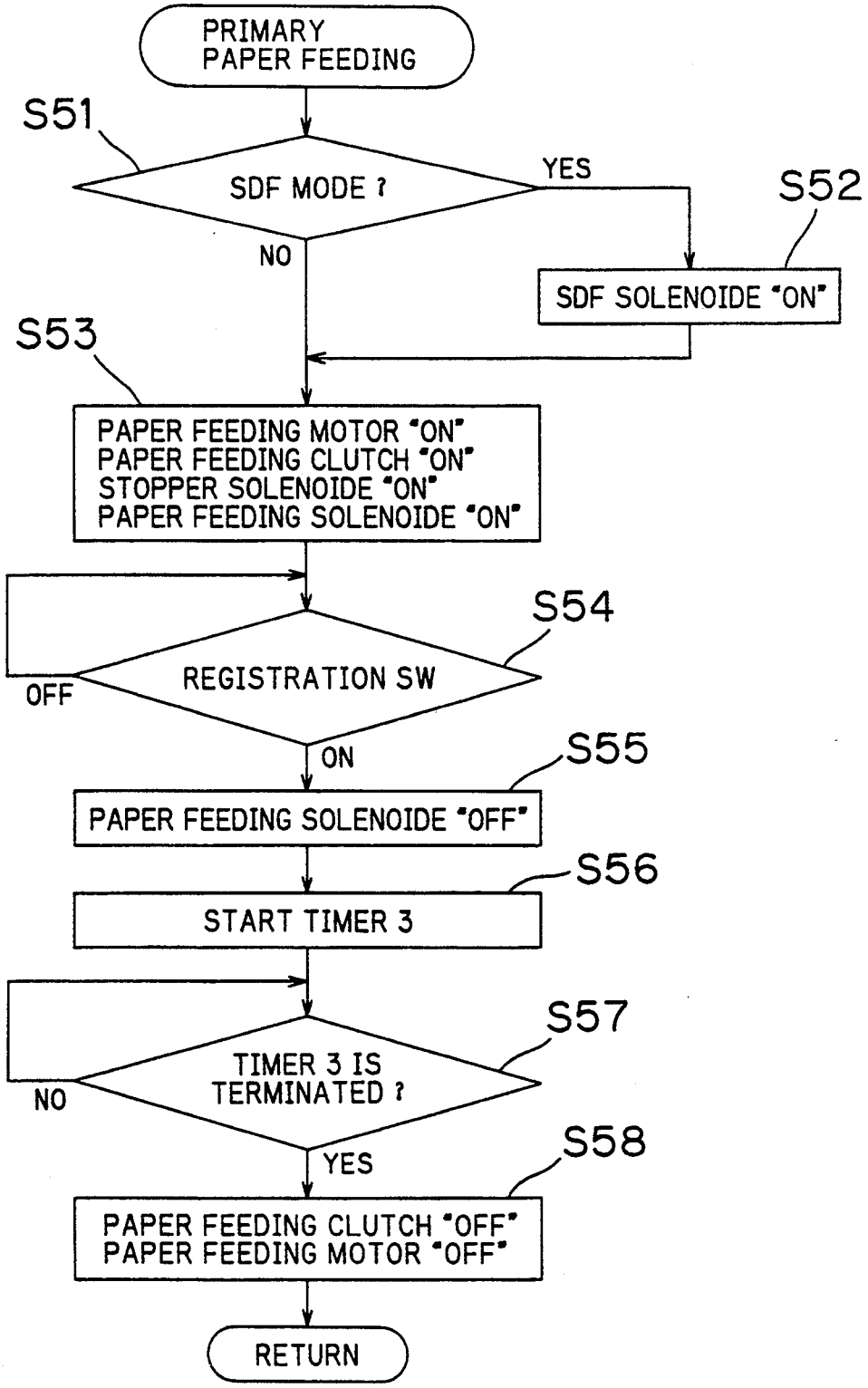
FIG. 6 is a flow chart showing the detailed contents of control concerning primary paper feeding.

FIG. 6 is a flow chart showing the detailed contents of control concerning the primary paper feeding described in the step S14 shown in FIG. 4. Referring now to FIG. 6, the control concerning the primary paper feeding will be described.

In the control concerning the primary paper feeding, it is first judged whether or not the SDF mode is selected (step S51).

If it is judged that the SDF mode is selected, the SDF solenoid 38 shown in FIG. 2 is turned on (step S52). If the SDF solenoid 38 is turned on, the documents cannot be separated from each other by the separation plate 37, and the reverse roller 11 is not rotated in the reverse direction, not to perform processing for preventing the documents from being fed with they being overlapped with each other, as described in FIG. 2. In this case, the reverse roller 11 follows the paper feeding roller 10. The program proceeds to the step S53.

On the other hand, if it is judged in the step S51 that the SDF mode is not selected, the program directly proceeds to the step S53.

In the step S53, the paper feeding motor 17 is turned on and the paper feeding clutch 64 is turned on, so that the rotation of the forward roller 9 and the paper feeding roller 10 is started. In addition, the stopper solenoid 67 is turned on so that the stopper member 6 is rotated in the counterclockwise direction to open the passage, and the paper feeding solenoid 66 is turned on so that the front end of the document is pressed against the forward roller 9 by the document pressing member 15.

When it is judged that the registration switch 13A is turned on after the primary paper feeding is started (ON in the step S54), the paper feeding solenoid 66 is turned off (step S55), so that the pressing by the document pressing member 15 is released because its purpose is accomplished. A timer 3 is started (step S56). The timer 3 measures third predetermined time required to make the document flex in a so-called loop shape in the registration roller 12 to correct the oblique feeding of the document.

When the measurement of time made by the timer 3 is terminated (step S57), the paper feeding clutch 64 and the paper feeding motor 17 are turned off (step S58).

The foregoing are the detailed contents of the control concerning the primary paper feeding in the present embodiment.

Figure 7:
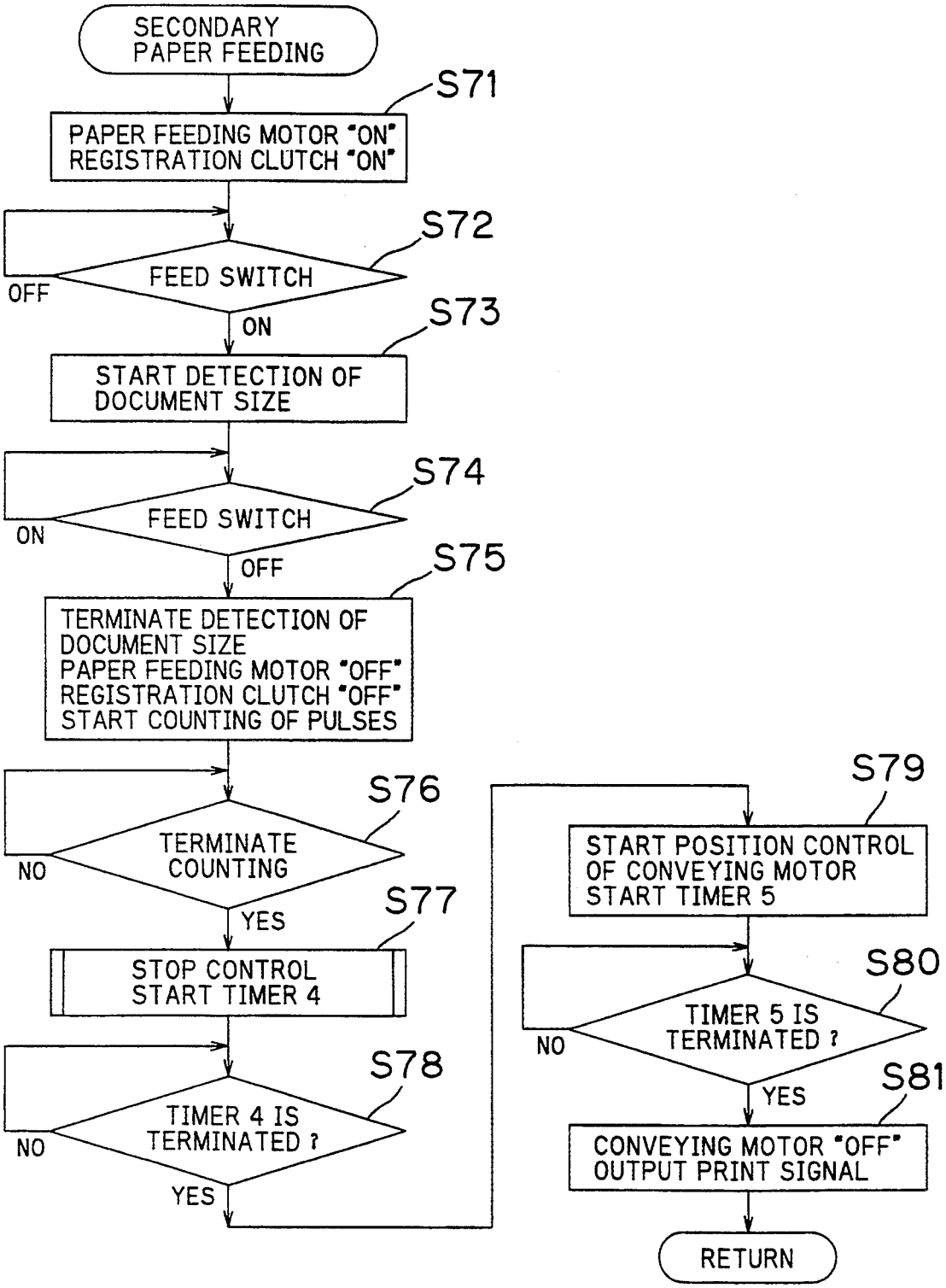
FIG. 7 is a flow chart showing the detailed contents of control concerning secondary paper feeding.

FIG. 7 is a flow chart showing the detailed contents of the control concerning the secondary paper feeding described in the step S15 shown in FIG. 4. Referring now to FIG. 7, the control concerning the secondary paper feeding will be described.

In the control concerning the secondary paper feeding, the paper feeding motor 17 is first turned on, and the registration clutch 65 is turned on (step S71). Consequently, the rotation of the registration roller 12 is started, so that the conveyance of the document by the registration roller 12 is started.

When the front end of the document conveyed passes through the feed switch 14, the feed switch 14 is turned on. If it is judged that the feed switch 14 is changed from an off state to an on state (step S72), the detection of the document size is started (step S73). The size in the width direction in the document size is detected by the size switches 13B and 13C. The detection of the document size in the step S73 is for detecting the length of the document in the direction of conveyance. When the rear end of the document conveyed passes through the feed switch 14, the feed switch 14 is switched from an on state to an off state. If it is judged that the feed switch 14 is switched from an on state to an off state (step S74), the detection of the document size is terminated (step S75). The detection of the document size from the step S72 to the step S74 may be performed by, for example, measuring the ON time of the feed switch 14 or counting the number of output pulses of the photointerrupter for a paper feeding motor 19 for the ON time.

Furthermore, at the same time that the detection of the document size is terminated, the paper feeding motor 17 and the registration clutch 65 are turned off, and counting of pulses outputted from the photointerrupter for a conveying motor 23 is started (step S75).

If the counting of a predetermined number of pulses is terminated (YES in the step S76), a timer 4 is started and stop control is carried out (step S77).

It is at the time point where the rear end of the document conveyed passes through the feed switch 14 that the feed switch 14 is turned off. As shown in FIG. 1, there is a predetermined distance from the feed switch 14 to the reference line 26. The document must be further conveyed by this distance. In order to exactly control this amount of conveyance, the number of pulses of the photointerrupter for a conveying motor 23 is counted. The amount of conveyance by the conveying belt 20 is proportional to the number of output pulses of the photointerrupter for a conveying motor 23. Accordingly, the number of reference pulses of the photointerrupter for a conveying motor 23 which corresponds to the amount of conveyance from the feed switch 14 to a position just ahead of the reference line 26 has been previously detected, and it is judged in the step S76 that the counting is terminated when the number of output pulses of the photointerrupter for a conveying motor 23 reaches the reference number of pulses.

In this case, the reference number of pulses may not be always constant but may be corrected depending on the document size detected in the step S75. The reference number of pulses may be corrected in the following manner.

For example, the amount of correction of pulses Xn ($n=1, 2, 3, \ldots$ : Xn is a value determined for each document size) is previously set in a memory provided in the ADF main circuit control section 61, and the amount of correction of pulses Xn is added to the reference number of pulses X depending on the detected document size, to calculate the corrected number of pulses $X'=X+Xn$. It may be judged that the counting is terminated when the number of output pulses of the photointerrupter for a conveying motor 23 reaches the corrected number of pulses X'.

The stop control in the step S77 characterizes the present embodiment. The contents of the stop control are changed depending on whether the automatic paper conveying device is in the ADF mode in which normal documents are conveyed or the SDF mode in which thin documents are conveyed. The details thereof will be described later.

In the step S77, a timer 4 is also started. The timer 4 is a timer for preventing an abnormal state. Generally if the stop control of the conveying motor 21 is carried out, the conveying motor 21 is stopped. In the abnormal state, however, the conveying motor 21 may not, in some cases, be completely stopped because it continues to coast and rotate, for example. Therefore, sufficient time for the stop control of the conveying motor 21 is measured by the timer 4. When the timer 4 reaches the full count, the program proceeds to the subsequent control even if the conveying motor 21 coasts and rotates at low speed.

When the measurement of time made by the timer 4 is terminated (YES in the step S78), position control of the conveying motor 21 is started and at the same time, a timer 5 is started (step S79). The position control of the conveying motor 21 is such control as to properly set the document so that the rear end of the document is brought into contact with the reference line 26 by rotating the conveying motor 21 in the reverse direction and switching the document back so that the rear end of the document collides with the document abutting member 25 provided on the reference line 26. In the position control, the conveying motor 21 is rotated in the reverse direction by predetermined number of pulses. The timer 5 measures sufficient time required for the position control for the purpose of control after the termination of the position control. When the measurement of time made by the timer 5 is terminated, the position control has been already completed (YES in the step S80). An OFF signal is applied to the conveying motor 21, and a "PRINT" signal meaning that the setting of the document is completed is outputted to the copying machine control section 69 (step S81).

The foregoing are the detailed contents of the control concerning the secondary paper feeding.

The contents of the stop control described in the step S77 shown in FIG. 7 will be described while referring to a waveform diagram of FIG. 8 and a flow chart of FIG. 9. FIG. 9 shows the contents of control corresponding to the steps S76 to S79 shown in FIG. 7. FIG. 7 is a flow chart showing a control operation of the ADF main circuit control section 61, while FIG. 9 is a flow chart showing a control operation of the motor control section 62.

Figure 8A:
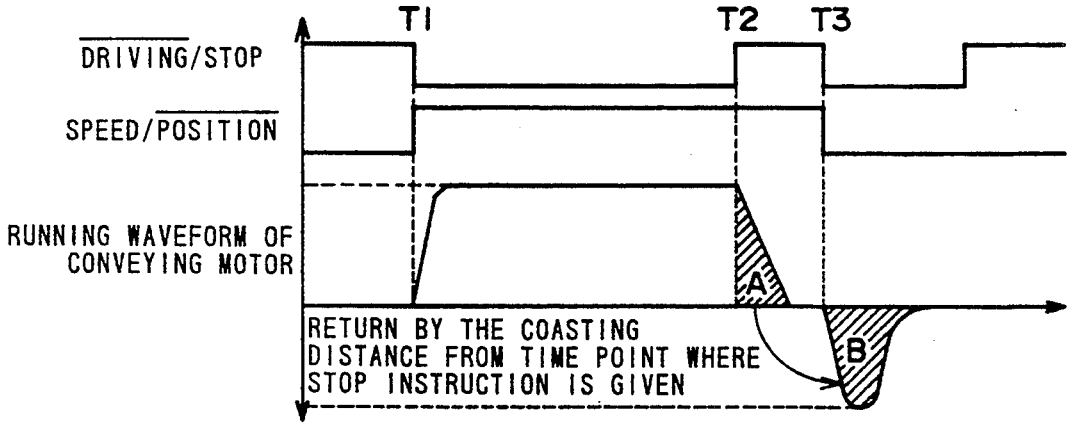
FIGS. 8A and 8B are waveform diagrams for explaining the contents of control which characterizes the present embodiment.
Figure 9:
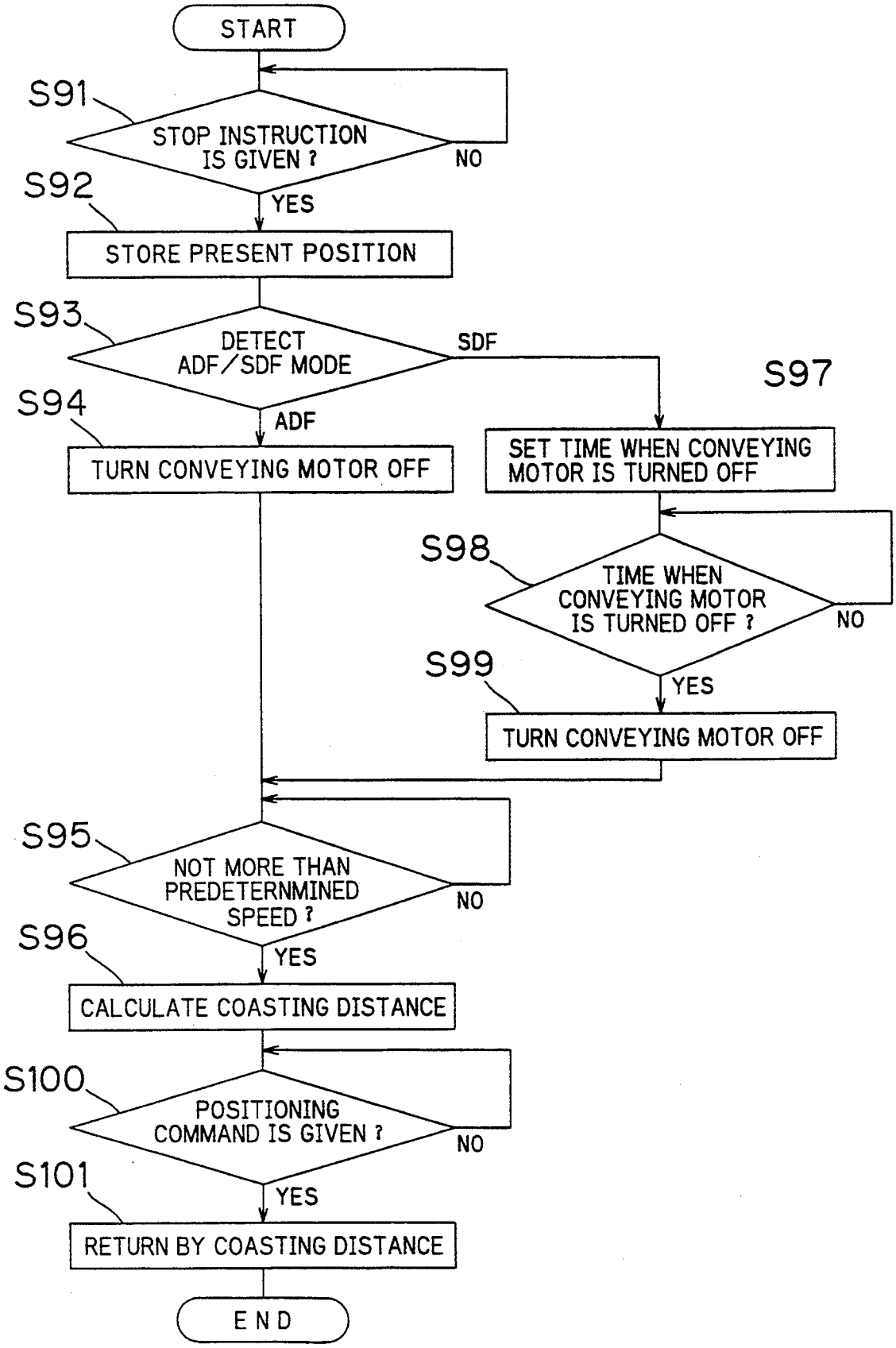
FIG. 9 is a flow chart showing the contents of control which characterizes the present embodiment.

In the ADF mode, at timing T1 shown in FIG. 8A, an ON signal and a speed control signal of the conveying motor 21 are applied to the motor control section 62 from the ADF main circuit control section 61. This timing T1 corresponds to the step S7 or S24 in the whole flow chart described above (FIG. 4 and 5). The motor control section 62 applies a PWM signal to the conveying motor 21 on the basis of input of the ON signal and the speed control signal, to carry out speed control of the conveying motor 21. Accordingly, the running waveform of the conveying motor 21 is raised so that the conveying motor 21 is rotated at constant speed, as shown in the waveform diagram of FIG. 8A. The foregoing state is not shown in the flow chart of FIG. 9.

Thereafter, at timing T2, a stop instruction of the conveying motor 21 is given to the motor control section 62 from the ADF main circuit control section 61 (step S91 in FIG. 9). The stop instruction is outputted by judgment of the ADF main circuit control section 61 that the counting is terminated in the step S76 shown in FIG. 7.

The motor control section 62 first stores the present position in response to the stop instruction (step S92). The storage of the present position is to clear a counter contained in the motor control section 62 to, for example, "0" and then, cause the counter to always count up detection pulses applied from the photointerrupter for a conveying motor 23. Alternatively, the storage of the present position is to set a predetermined value, for example, "10000" in the counter contained in the motor Control section 62 and then, cause the counter to count from 10000 down by detection pulses applied from the photointerrupter for a conveying motor 23.

In the motor control section 62, it is then judged whether the operation mode of the document conveying device is the ADF mode or the SDF mode (step S93).

If it is judged that the operation mode is the ADF mode as a result of the judgment, the supply of the PWM signal supplied to the conveying motor 21 is immediately stopped. That is, the conveying motor 21 is turned off (step S94). The conveying motor 21 is not immediately stopped if it is turned off but coasts by the inertia. Accordingly, the conveying motor 21 is decelerated to be stopped from the time point where it is turned off, that is, from the timing T2, as shown in the waveform diagram of FIG. 8A.

In the motor control section 62, therefore, the detection pulses from the photointerrupter for a conveying motor 23 are counted from the timing T2 at which the coasting by the inertia is started (i.e., step S94). When no detection pulse from the photointerrupter for a conveying motor 23 is applied and more specifically, when a state where the counted value of the counter for counting detection pulse from the photointerrupter for a conveying motor 23 is not changed continues, it is judged that the conveying motor 21 reaches not more than a predetermined speed at which it is completely stopped or almost completely stopped (step S95). The coasting distance is calculated on the basis of the counted value of the counter (step S96). Since the coasting distance of the conveying motor 91 is directly proportional to the number of detection pulses applied from the photointerrupter for a conveying motor 23, this counted number of the counter represents the coasting distance. The counted number corresponds to the area of a region A hatched in FIG. 8A.

On the other hand, when it is judged in the step S93 that the operation mode is the SDF mode, the supply of the PWM signal to the conveying motor 21 is not immediately stopped. Alternatively, timing at which the conveying motor 21 is turned off is delayed by a predetermined time or until the document is moved by a predetermined distance.

More specifically, in the case of the SDF mode, the time when the conveying motor 21 is turned off is set (step S97). For example, the timer is set, or a counter for counting detection pulses from the photointerrupter for a conveying motor 23 (this counter differs from the counter used in the step S92) is set. It is Judged that the time when the timer measures a predetermined short time or the counter counts a predetermined number is the time when the conveying motor 21 is turned off (step S98), and the supply of the PWM signal to the conveying motor 21 is stopped. That is, the conveying motor 21 is turned off (step S99). Thereafter, the program proceeds to control in the step S95.

Figure 8B:
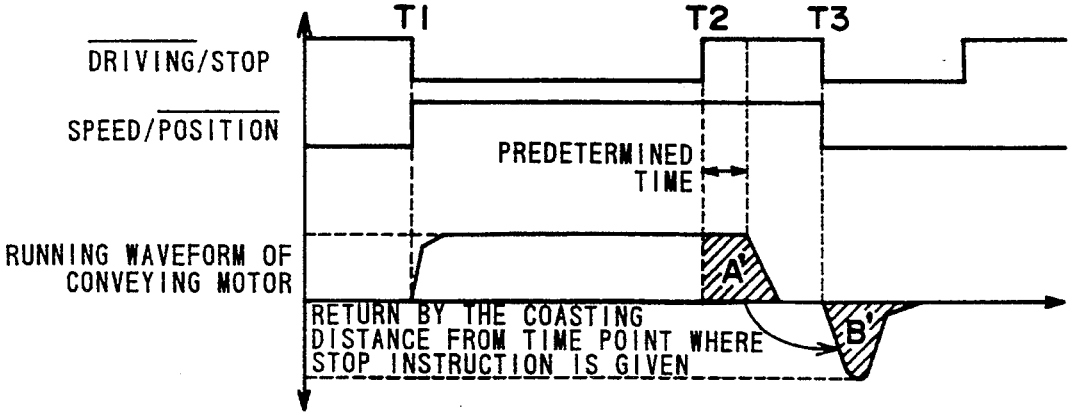

The control in the steps S97 to S99 is processing for delaying the timing at which the conveying motor 21 is turned off by a predetermined short time AT from the timing T2 at which a belt stop signal is applied, in FIG. 8B. If such delay processing is performed only in the case of the SDF mode, the coasting distance calculated in the step S96 corresponds to the area of a region A′ hatched in FIG. 8B. As a result, also in the SDF mode in which the document is conveyed at low speed, the coasting distance becomes not a significantly small value but a sufficient value required for later switchback control of the conveying motor 21.

As described in the foregoing, the present embodiment is characterized in that in the case of the SDF mode in which the document is conveyed at lower speed, as compared with the ADF mode in which the document is conveyed at the normal conveying speed, the conveying motor 21 is not immediately turned off in response to the stop instruction but the timing at which the conveying motor 21 is turned off is delayed by a predetermined short time. When the position control of the conveying motor 21 is carried out thereafter, sufficient coasting distance data required for the position control is obtained by delaying the timing at which the conveying motor 21 is turned off.

Meanwhile, the timing at which the conveying motor 21 is turned off may be delayed not for a predetermined short time but until a particular number of detection pulses of the photointerrupter for a conveying motor 23 are counted as described above.

Thereafter, a positioning command is given to the motor control section 62 from the ADF main circuit control section 61 at timing T3 in either the ADF mode or the SDF mode. This timing T3 corresponds to the step S78 in the flow chart of FIG. 7. When the measurement of time made by the timer 4 is terminated, the positioning command is given to the motor control section 62 from the ADF main circuit control section 61 (step S100).

The motor control section 62 carries out the position control of the conveying motor 21 by applying a PWM signal for reverse rotation to the conveying motor 21 on the basis of the positioning command, thereby to rotate the conveying motor 21 in the reverse direction by a coasting distance (step S101).

The reverse rotation control, that is, the position control of the conveying motor 21 based on this positioning command is such control as to reliably stop the conveying motor 21 in a target stop position by representing a command speed V by, for example, a linear function of position X.

More specifically, a constant k times the counted number X representing the coasting distance calculated in the step S96 is applied to the conveying motor 21 as a command speed V (this command speed is outputted as, for example, a PWM signal). At this time, the counted number X is subtracted every time the detection pulse is applied from the photointerrupter for a conveying motor 23 as the conveying motor 21 is rotated. Consequently, in the position control, it is possible to rotate the conveying motor 21 in the reverse direction by a distance corresponding to the coasting distance A shown in FIG. 8A or the coasting distance A′ shown in FIG. 8B. That is, it is possible to rotate the conveying motor 21 in the reverse direction by a distance corresponding to the area of a region B or B′ hatched in FIG. 8A or 8B, that is, a distance equal to the coasting distance corresponding to the region A or A′.

When the command speed V becomes zero, that is, the counted value becomes zero, it is judged that the conveying motor 21 reaches a target position. Consequently, the supply of the PWM signal for position control applied to the conveying motor 21 is stopped.

The above described position control may be carried out not by representing a command speed V by a linear function of position X as described above but by setting V to $\sqrt{2AX}$ (where A is acceleration). The details of such position control are disclosed in the prior application of the applicant (see Japanese Patent Application Serial No. 2-40025).

Furthermore, a pulse output device for outputting pulses as a conveying belt is moved in place of the detection pulses of the photointerrupter for a conveying motor 23 may be provided to carry out position control using the pulses.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A paper conveying device comprising:

paper conveying means moved in a first direction to convey paper in the first direction and moved in a second direction to convey the paper in the second direction;

pulse outputting means for outputting pulses in synchronism with the movement of the paper conveying means;

mode detection means for detecting that the operation mode is a predetermined mode;

stop signal outputting means for outputting a stop signal to the paper conveying means when the paper conveyed in the first direction by the paper conveying means is in a predetermined position;

counting means for starting counting of the pulses outputted from the pulse outputting means in response to the stop signal outputted from the stop signal outputting means;

additional driving signal outputting means for outputting a driving signal so as to move the paper conveying means in the first direction only for a predetermined short time subsequently after the stop signal is outputted from the stop signal outputting means when the mode detection means detects that the operation mode is the predetermined mode; and position controlling means for reading a counted value of the counting means after carrying out such control as to move the paper conveying means in said first direction, to move the paper conveying means by the counted value in the second direction.

2. The paper conveying device according to claim 1, wherein the mode detection means detects whether the operation mode is a normal mode in which the paper conveying speed of the paper conveying means is a standard speed or a special mode in which the paper conveying speed is lower than the standard speed, to output a detection signal when the operation mode is the special mode.

3. The paper conveying device according to claim 2, wherein the paper conveying means comprises a conveying motor, and the pulse outputting means outputs pulses in synchronism with the rotation of the conveying motor.

4. The paper conveying device according to claim wherein the paper conveying means comprises a paper conveying belt and a conveying motor for driving the paper conveying belt, and the pulse outputting means outputs pulses in synchronism with the movement of the paper conveying belt.

5. A paper conveying device comprising:

paper conveying means moved in a first direction to convey paper in the first direction and moved in a second direction to convey the paper in the second direction;

pulse outputting means for outputting pulses in synchronism with the movement of the paper conveying means;

mode detection means for detecting that the operation mode is a predetermined mode;

stop signal outputting means for outputting a stop signal to the paper conveying means when the paper conveyed in the first direction by the paper conveying means is in a predetermined position;

counting means for counting the pulses outputted from the pulse outputting means in response to the stop signal outputted from the stop signal outputting means;

additional driving signal outputting means for outputting a driving signal so as to move the paper conveying means in the first direction until a predetermined number of pulses are outputted from the pulse outputting means subsequently after the stop signal is outputted from the stop signal outputting means when the mode detection means detects that the operation mode is the predetermined mode; and position controlling means for reading a counted value of the counting means after carrying out such control as to move the paper conveying means in the first direction, to move the paper conveying means by the counted value in the second direction.

6. The paper conveying device according to claim 5, wherein the mode detection means detects whether the operation mode is a normal mode in which the paper conveying speed of the paper conveying means is a standard speed or a special mode in which the paper conveying speed is lower than the standard speed, to output a detection signal when the operation mode is the special mode.

7. The paper conveying device according to claim 6, wherein the paper conveying means comprises a conveying motor, and the pulse outputting means outputs pulses in synchronism with the rotation of the conveying motor.

8. The paper conveying device according to claim 6, wherein the paper conveying means comprises a paper conveying belt and a conveying motor for driving the paper conveying belt, and the pulse outputting means outputs pulses in synchronism with the movement of the paper conveying belt.

* * * * *